United States Patent [19]

Prince

[11] 4,058,487

[45] Nov. 15, 1977

[54] QUICK LATHERING TOILET BARS AND METHOD OF MAKING SAME

[75] Inventor: Leon M. Prince, Westfield, N.J.

[73] Assignee: Lever Brothers Co., New York, N.Y.

[21] Appl. No.: 695,708

[22] Filed: June 14, 1976

Related U.S. Application Data

[60] Division of Ser. No. 419,558, Nov. 28, 1973, Pat. No. 3,989,647, which is a continuation of Ser. No. 137,288, April 28, 1973, abandoned, which is a continuation-in-part of Ser. No. 54,008, July 10, 1970, abandoned.

[51] Int. Cl.[2] ..... C11D 1/12

[52] U.S. Cl. ..... 252/552; 252/DIG. 16; 252/121; 252/174; 252/535; 252/537; 252/554; 252/557

[58] Field of Search ..... 252/121, 535, 537, 554, 252/557, DIG. 16, 174, 552

[56] References Cited

U.S. PATENT DOCUMENTS

| | | | |
|---|---|---|---|
| 3,043,778 | 7/1962 | Kelly | 252/107 |
| 3,186,948 | 6/1965 | Sweeney | 252/DIG. 16 |
| 3,291,744 | 12/1966 | Bohrer | 252/106 |
| 3,376,229 | 4/1968 | Haass et al. | 252/DIG. 16 |
| 3,576,749 | 4/1971 | Megson et al. | 252/132 |

FOREIGN PATENT DOCUMENTS

| | | |
|---|---|---|
| 890,696 | 3/1962 | United Kingdom |

*Primary Examiner*—Mayer Weinblatt

*Attorney, Agent, or Firm*—James J. Farrell; Kenneth F. Dusyn; Melvin H. Kurtz

[57] ABSTRACT

A non-mushing high lathering synthetic toilet bar comprising, based on the total weight of the actives, 40–85% of $C_{12}$ alkane sulfonate, 5–35% of a $C_{12}$ natural or synthetic fatty acid, and 5–30% of an additive selected from the group consisting of hydroxyalkane sulfonates, alkylmethyl taurides, hydroxyalkylmethyl taurides, alkyl phosphates, mono-alkyl succinates and maleates, alkane disulfonates, acyl isethionates, alkyl sulfates and alkene sulfonates.

8 Claims, 4 Drawing Figures

QUICK LATHERING TOILET BARS AND METHOD OF MAKING SAME

Figure 1:
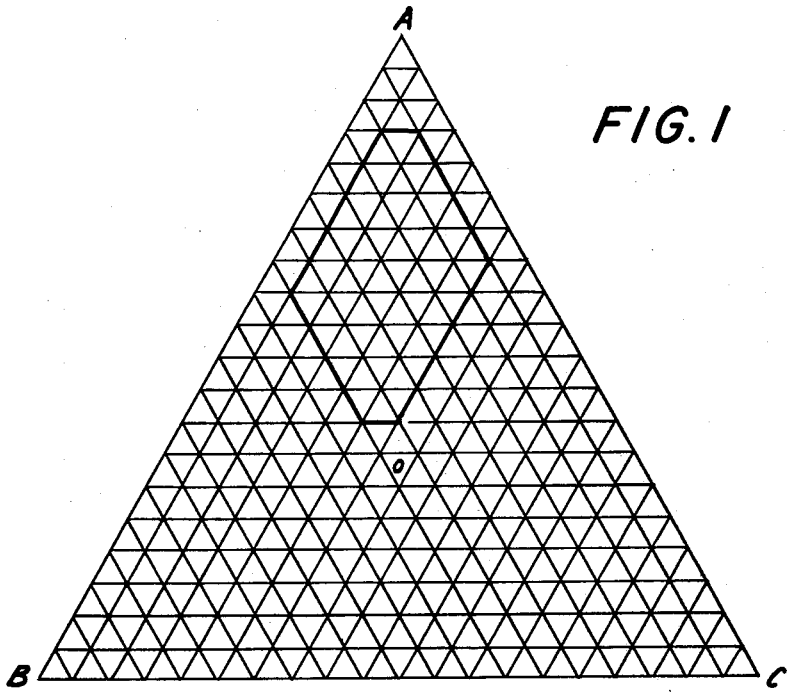

This application is a division of application Ser. No. 419,558, filed Nov. 28, 1973, now U.S. Pat. No. 3,989,647, which is a continuation of application Ser. No. 137,228, filed Apr. 28, 1973, now abandoned, which is a continuation-in-part application of Ser. No. 54,008, filed July 10, 1970, now abandoned.

1. Field of Invention

Detergent bars.

2. Description of the Prior Art

The ideal toilet bar should have certain characteristics. For example, a toilet bar should possess good detergency when used on the skin and other surfaces in all kinds of water including hard, soft, sea, cold and hot. It should also exhibit excellent lathering qualities in all types of water and be mild and non-injurious to the skin. It should also have a pleasing appearance, rinse off easily and have a pleasing feel after use. The toilet bar itself should exhibit little or no tendency toward softening, blooming, crystallizing, cracking, drying or decomposing under storage conditions, and further have the ability to be produced in standard soap-making equipment.

Toilet bars prepared from soap have many of the aforementioned qualities, but as a class generally are deficient in one or more aspects and particularly with regard to lathering qualities under varying water conditions.

The addition of a synthetic detergent to soap to improve performance in hard and cold water has been practiced for many years, but the major objection to such combinations still resides in lather characteristics.

On the other hand, bars made principally of non-soap synthetic detergent are not satisfactory due to high hydroscopicity, unsatisfactory solubility characteristics, extreme defatting action on the skin, and lack of lubricant effect usually associated with soap, poor working properties in standard soap machinery, brittleness and poor cohesion or excessive softness of the bar itself. For example, alkyl benzene sulfonates are in general excellent from the standpoint of being able to produce lather in hard water, but, when used by themselves, result in detergent bars which are much too soft and sticky. Accordingly, in order to correct these deficiencies, the prior art suggests incorporation of various binders and fillers: however, bars so prepared still do not have the feel and other properties desirable in a toilet bar. In addition, bars made containing such constituents are difficult to process in conventional equipment.

Normally, alkene sulfonates made by adding $SO_3$ to an $\alpha$-olefin, although being much harder than alkyl benzene sulfonates, become very sticky when small percentages of water are incorporated in a formed detergent bar. As a consequence, bars made from these materials are also very difficult to process in the usual soap-making equipment, and additionally have a tacky after-feel on the hands and also exhibit a wear rate which is extremely high, and thus are undesirable notwithstanding the fact that the lather evolved is of excellent quality.

Other synthetic detergents such as alkyl sulfates, sarcosinates, mono-alkyl succinates, coco methyl tauride and the like, although offering many advantages, are either too harsh in the ranges that they lather, require critical conditions to plod successfully, or are too expensive to be used as the main ingredient in detergent bars.

The alkane sulfonates, particularly in the $C_8$–$C_{18}$ molecular weight range have also been suggested for use in detergent compositions. These materials are hard, at least as mild as soap, and will tolerate up to 25% water without becoming sticky. When used by themselves, however, even with 25% water these materials do not possess the desired plasticity characteristic of soap. Thus, they are difficult to process in that they are too hard to plod and stamp successfully. Moreover, the quality of lather evolved leaves much to be desired in volume and in creaminess. In order to correct these defects, the prior art (Canadian Pat. No. 636,022; U.S. Pat. No. 3,442,812; and U.S. Pat. No. 2,781,321) suggests incorporation in addition to the primary alkane a fatty acid plus other optional ingredients. It has been found, however, that when toilet bars are prepared in accordance with this prior art, the resulting product suffers severely in lathering characteristics and may be quite mushy.

SUMMARY OF THE INVENTION

An inexpensive, synthetic detergent toilet bar is provided having superior lathering properties under all water conditions, which is mild and has a soap-like after-feel to the skin, which is non-mushing under conditions of use and is readily processed with conventional soap-making equipment by incorporating in selected proportions an alkane sulfonate containing 12 carbon atoms in the alkyl chain or a mixture of alkane sulfonates averaging 12 carbon atoms in the alkyl chain, a superfatting agent comprising natural or synthetic fatty acids containing 12 carbon atoms or mixtures of said acids averaging 12 carbon atoms and a binder modifier selected from the group consisting of hydroxyalkane sulfonates, acyl ($C_{10}$–$C_{16}$) isethionates, alkylmethyl taurides, hydroxyalkylmethyl taurine, alkyl sulfates, alkyl phosphates, alkyl phosphonates, alkyl sulfosuccinates, mono-alkyl succinates, mono-alkyl succinates and maleates, alkane disulfonates and alkene sulfonates. The bar so provided has a composition comprising, based on the active present, of about 40% to about 80% by weight of the alkane sulfonate, about 5% to about 35% of a natural or a synthetic fatty acid, and 5% to about 30% of a binder modifier, and based on the total weight of the bar 5% to about 25% water.

DESCRIPTION OF THE INVENTION

I have found that a relatively inexpensive and readily available synthetic detergent material, which by itself does not make a good toilet bar, can be utilized in accordance with the present invention to provide a toilet bar which exhibits extraordinary qualities of lather evolution and creaminess, has a low wear rate, is readily processable but does not mush under conditions of use.

In accordance with the teachings of the present invention, toilet bars of improved performance qualities may be prepared by combining a select group of alkane sulfonates (A) with a select group of superfatting agents (B), and specific binder modifier (C) in critical proportions indicated by the cross-hatched area of the triangular graph of FIG. 1.

FIGS. 1–4 graphically illustrate the present invention. FIG. 1 illustrates the workable ranges of active components of the detergent toilet bar of the present invention. The proportions of the active components (A), (B) and (C) comprising the bar are shown in the equilateral triangle. When the bar contains 100% alkane sulfonate (A), the point representing this composition is the top apex of the triangle. Similarly, the point representing 100% binder modifier (C) is the right hand apex and the point for 100% superfatting agent (B) is the left hand apex. A composition containing equal parts of the three components is represented by point O. It is thus obvious that any composition containing the three components may be represented by a point on the triangular graph of FIG. 1.

Figure 2:
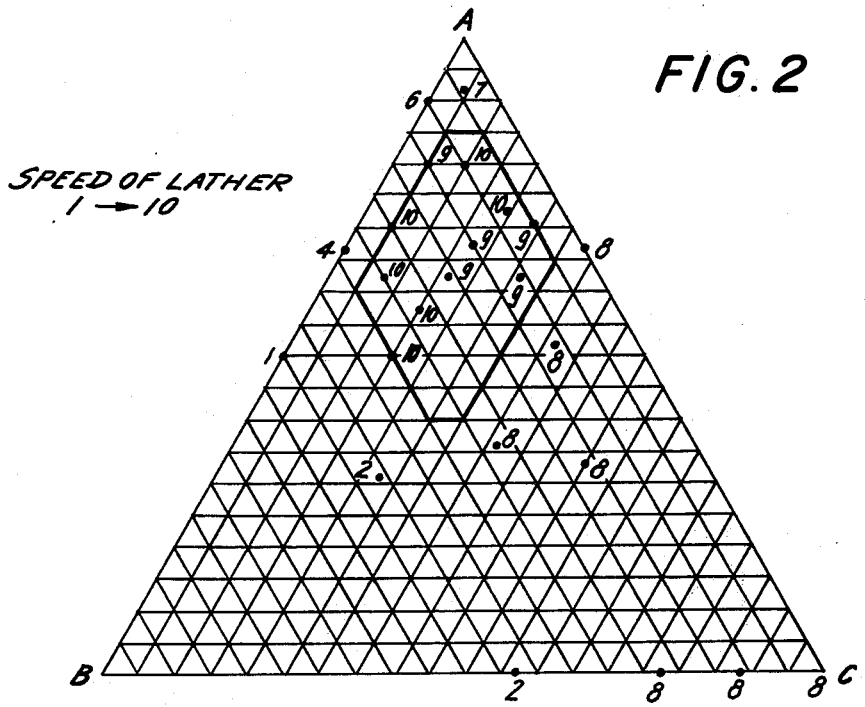

FIG. 2 is also a triangular graph indicating lather speed ratings of the detergent bars at different compositional levels set forth in FIG. 1. More specifically, in FIG. 2 the speed of lather ratings is superimposed on the compositional points of FIG. 1. For example, lathering properties (speed) were rated from 0–10 as will hereinafter be explained. In addition, compositions containing a speed of lather rating of 9 or higher are conveniently delineated, as shown within the cross-hatched area of triangular graph of FIG. 2.

Figure 3:
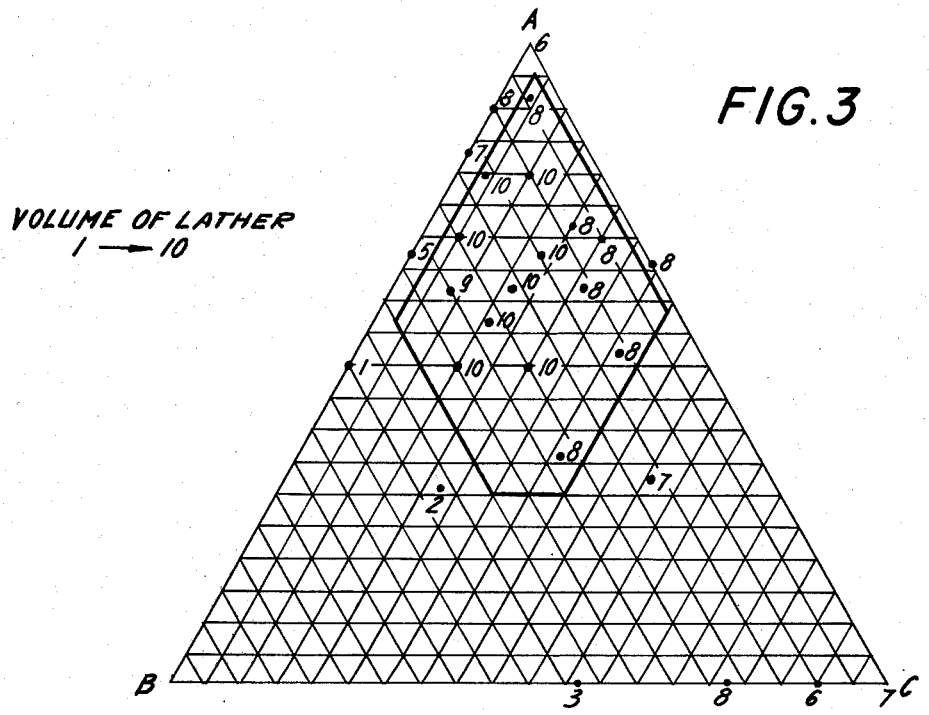
Figure 4:
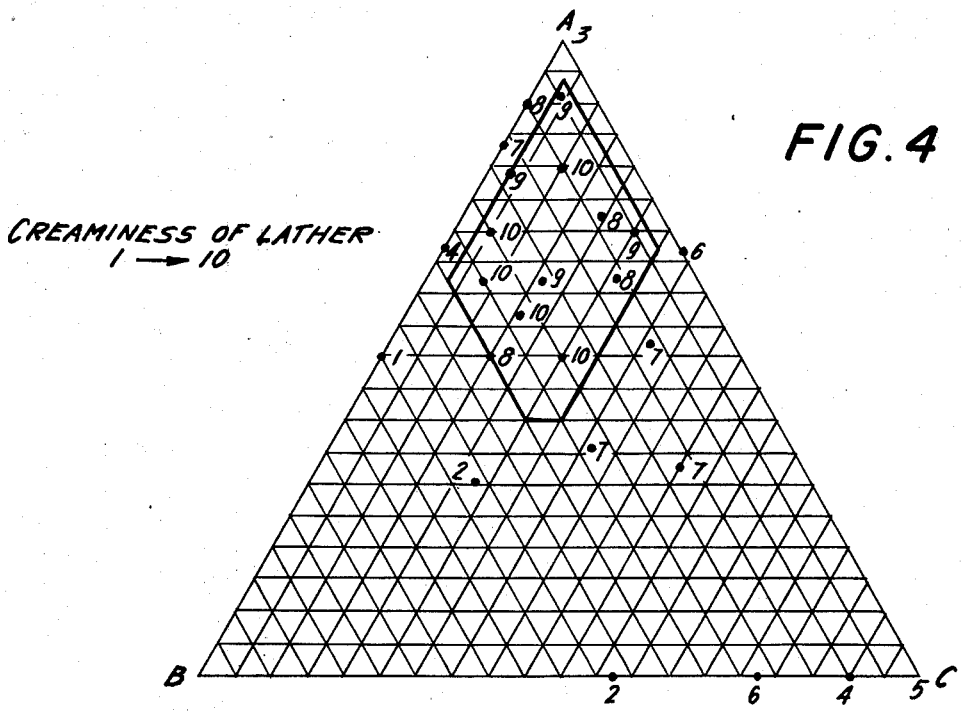

FIGS. 3 and 4 indicate creaminess and lather volume ratings corresponding to compositional points; satisfactory creaminess and lather volume being signified by a value greater than S and signified by cross-hatched areas.

Thus the graphs presented by FIGS. 1–4 permit one to superimpose ratings for performance parameters upon compositional points. Where the areas of the desired characteristics overlap, one can select a range of compositions in which all desirable attributes are simultaneously achieved and even when areas do not overlap, at least a compromise can be judicially determined.

The alkane sulfonates (A), which form the principal ingredient of the synthetic detergent bars of the present invention, are alkali metal, magnesium or ammonium salts of a commercial alkane sulfonate made for example by the addition of sodium bisulfite to linear Ziegler $\alpha$-olefins or alkane sulfonates made from $\alpha$-olefin derived from cracked wax and thus contain from about 85% to 95% active alkane sulfonate, the balance being sodium sulfate and related inorganic salts.

In addition to the critical proportions of alkane sulfonate required to form the detergent bar of the present invention, the length of the alkyl chain of the alkane sulfonate is also quite critical. Thus it is essential that the alkyl chain contain about 12 carbon atoms or comprise a mixture of alkane sulfonates having varying chain lengths of about 8 to about 16 but averaging 12 carbon atoms.

In addition, the position of the polar sulfonate group on the hydrocarbon chain is important. The bulk of the polar group should be in the No. 1 position, but a small proportion may be in the 2 or 3 position. For example, a completely random distribution of the polar groups in the hydrocarbon chain is completely unacceptable, since such a distribution favors a mushy product. Thus the alkane sulfonates employable in the present invention are essentially of the primary and secondary type.

The superfatting agents (B), which also form an important ingredient in the synthetic detergent bar of the present invention, are derived from natural or synthetic fatty acids which also have a chain length of 12 carbon atoms or comprise mixtures of said acids containing chain lengths averaging 12 carbon atoms. However, when mixtures are used, it is important that the major proportion not contain fatty acids having a chain length of above 16 carbon atoms or below 8 carbon atoms. Thus, so long as the natural or synthetic fatty acids have the chain lengths aforementioned, any of the fatty acids commonly found and utilized in soap bar toilet detergents may be utilized.

The third ingredient (C), which is required in forming the detergent bars of the present invention, are binder modifiers which are solids at room temperature and comprise alkali metal, magnesium or ammonium salts selected from the group consisting of:

$C_{12}$–$C_{16}$ hydroxyalkane sulfonates (wherein the hydroxyl group is removed at least 1 carbon atom from the sulfonate group),
$C_{10}$–$C_{16}$ acyl isethionates,
$C_{10}$–$C_{16}$ alkylmethyl taurides,
$C_{10}$–$C_{16}$ hydroxyalkylmethyl tauride,
$C_{12}$–$c_{18}$ primary alkyl sulfates,
$C_{12}$–$C_{16}$ primary alkyl phosphonates and phosphates,
$C_{12}$–$C_{16}$ mono-alkyl succinates and maleates,
$C_6$–$C_{14}$ dialkylsulfosuccinates,
$C_{16}$–$C_{20}$ alkane disulfonates, and
$C_8$–$C_{18}$ alkene sulfonates.

The choice of binder modifier within the group enumerated above is quite important. More specifically, certain agents commonly found in detergent bars cannot be employed in the bars of the present invention. For example, the presence of even small amounts of alkylaryl sulfonates, carbowaxes and polyethylene glycol monostearates will either liquefy or unduly soften the bar. Similarly, use of certain higher fatty acids such as stearic acid will severely depress lather and fatty acid alkanolamides will cause discoloration.

In addition to the specifications for individual components of the detergent bars of the present invention, there are other strict requirements which must be met when the components are combined. The most important of these is pH. Suitable bars can only be made when the pH ranges from about 4.5 to 9.5. Above pH 9.5, the bar rapidly losses its lathering characteristics. This appears to indicate that the free fatty acid is changed into a soap and the soap so formed interferes with lather development in combination with the alkane sulfonate and also adversely affects plasticizing characteristics. Bar pH is particularly important when alkyl sulfates are employed as an ingredient in which case the pH should be greater than 7, otherwise the alkyl sulfate will rapidly hydrolyze.

Almost as important in lather development as is pH, is the chain length of the detergents and fatty acids. For example, the synthetic detergent bars of the present invention can tolerate only minor amounts of alkane sulfonates, fatty acids of binder modifiers having carbon chain lengths above $C_{16}$ without significant loss of lather volume. An equal effect will be noted in regard to mixtures of alkane sulfonates or fatty acids having significant amounts of chain lengths of less than 10 carbon atoms.

I have found that it is very advantageous to use mixtures of fatty acids and alkane sulfonates having chain lengths of between 10 and 14 in proportions sufficient to provide an average of 12 carbon atoms. When such proportions are employed, a synergistic phenomenon has been noted; the bar performs better than when the chain length is 12.

Bars were tested to confirm the superior properties obtained when prepared in accordance with the present invention. For example, the speed and magnitude of lather evolution of a detergent bar having the composition as determined by point X of FIG. 1, as compared with two commercial toilet bars, is set forth in Table 1.

Experienced hand lathering evaluators were asked to compare conventionally made toilet bars with toilet bars made in accordance with the teachings of the present invention. Each evaluator was asked to use his standard method of hand lathering when using each type of bar. The evaluator was required to wash with each bar at least three times to establish maximum volume of lather obtainable with it. The speed of lather was then determined by measuring in triplicate the elapsed time to reach the maximum volume. This time in seconds was recorded.

The procedure used for measuring the volume of lather was as follows:

Each evaluator used a washbowl in which to wash hands and the lather produced was collected in a separate graduated cylinder. Each evaluator used each bar three times in order to obtain an average volume of lather for that particular bar.

TABLE 1

| Bar | No. of Subjects | Subject* 1 | Subject* 2 | Subject* 3 | Subject* 1 | Subject* 2 | Subject* 3 |
|---|---|---|---|---|---|---|---|
| | | Seconds to Maximum Lather | | | ml. of Lather Evolved | | |
| Composition of Point X of Figure 1 | 3 | 4 | 3 | 4 | 187 | 430 | 150 |
| **Commercial Detergent Bar | 3 | 5 | 7 | 5 | 157 | 223 | 113 |
| ***Commercial Soap Bar | 3 | 8 | 11 | 15 | 127 | 113 | 97 |

*Readings are averages of 3 determinations in 105° F (tap water of 110 ppm hardness as $CaCO_3$)
**50% sodium acyl isothionate
***Based on 80/20 tallow/coco soap In order to further demonstrate the advantages of detergent bars prepared according to the present invention, the bars were tested to determine wear rate and resistance to mushing. Mush is a condition in which a used bar does not dry to its original firmness but retains a soggy outer layer. Mush was determined in the laboratory by subjecting the bar to hand washing conditions for 45 seconds in order to produce an in-use surface whereupon the bar was supported on an immersion rack and immersed in tap water at 75° F for a period of about 3 hours and then removed from the water and permitted to dry overnight. Mush was then measured by squeezing the bar firmly between the thumb and index finger, penetrating through the soggy outer layer until a firm base was reached and grading as follows:

N — Nil
T — Trace
S — Slight
M — Moderate
C — Considerable

The toilet bars were also tested to determine wear rate by subjecting them to conditions of use by submerging in water at 105° F, removing the bar from the water, and rotating the bar 20 times between the hands and repeating the procedure 2 times for a period totaling 40 rotations per wash. The test was repeated 4 times during the day for a period of 2 days, whereupon the soap bars were permitted to dry and the dry weight of the bar, after the tests, compared with the weight of the bar prior to use.

Table 2 indicates the mush value and wear rate of a detergent bar having the composition as determined by point X of FIG. 1 as compared with two commercial toilet bars.

TABLE 2

| Bar | Mush | Wear Rate |
|---|---|---|
| Composition of Point X of Figure 1 | N | 2.62 ± .153 |
| *Commercial Soap Bar | N | 2.55 ± .390 |
| **Commercial Detergent bar | M | 3.40 ± .254 |

*Based on 80/20 tallow/coco soap
**50% sodium acyl isothionate

As important as are use characteristics in determining the value of a formulation so are the properties which play a role in regard to the ability to properly process the bar. For example, it is possible to obtain a bar which possesses all the attributes of an ideal bar in respect to lather, wear rate, etc., but yet is unsuitable because it exhibits poor processing characteristics. More particularly, the composition may either plod poorly or exhibit poor stamping properties. The former characteristic relates to plasticity and the latter to adhesion and cohesion. For example, when cohesion is not properly adjusted, the bar powders or cracks during stamping or upon drying. Table 3 sets forth just a few of the compositions prepared in conjunction with the instant invention and demonstrates criticalities regarding proportion of ingredients as exhibited by the resulting effect on plodding, stamping and lather properties.

The ingredients (A, B and C) may be combined and formulated into toilet bars in accordance with any conventional method. For example, the essential ingredients may be first homogeneously blended together and then admixed in a chip mixer with other non-essential ingredients and water is an amount sufficient to form a product having a water content based on the total weight of the bar of about 5–25%. The mixture is then milled on a roller mill, plodded into logs, cut and finally stamped into bars.

Alternatively and preferably, the essential ingredients are first co-dissolved in a water-solvent system. The water-solvent system which can be used in the present invention, includes water and a solvent which can be readily mixed with water and will co-dissolve the detergent and the plasticizer of the present invention. Examples of such solvents are methyl alcohol, ethyl alcohol, propyl alcohol, isopropyl alcohol, acetone and/or mixtures of these with each other or related water soluble, low boiling point solvents. The volume ratio of water to solvent is preferably from about 3:1 to about 1:3.

After all the ingredients are completely dissolved, the water-solvent system is removed by processes well known to the art, such as vacuum drying, distillation, flash or drum drying.

The plasticized mixture of chips from the drying step may then be placed into a chip mixer where additional ingredients, normally found in toilet bars but which were not added during preparation of the solution, are blended to form a uniform mixture. The material is then formed into toilet bars in accordance with well-known methods in the art, such as will be found in U.S. Pat. Nos. 2,781,321 and 2,894,912.

TABLE 3

| Sample No. | Ingredients A % | B % | C % | Lather Avg. Eval. | Plodding Characteristic | Stamping Characteristic | Remarks |
|---|---|---|---|---|---|---|---|
| 399 | 67 | — | 33 | 8-8-6 | G | F | Mushy; wear rate high |
| 437 | 67 | 33 | — | 4-5-4 | F | U | |
| 472 | 53 | 11 | 36 | 8-8-7 | U | E | Bar cracked |
| *468 | 61 | 23 | 16 | 9-10-9 | E | E | |
| *471 | 68 | 14 | 18 | 9-10-10 | F | G | |
| 473 | 35 | 11 | 54 | 3-7-7 | U | G | Bar cracked |
| 474 | 50 | 50 | — | 1-1-1 | U | U | |
| 469 | — | 23 | 77 | 8-8-6 | G | U | Bar cracked |
| 475 | — | 11 | 89 | 8-6-4 | E | U | Bar cracked |
| 476 | 26 | 47 | 27 | 2-2-2 | F | U | Sticky |
| 477 | — | 43 | 57 | 2-3-2 | U | U | |
| 478 | 100 | — | — | 5-6-3 | U | U | |
| 479 | 91 | 4 | 5 | 7-8-9 | E | E | Bar cracked |
| *480 | 63 | 11 | 26 | 9-8-8 | E | E | |
| *481 | 57 | 14 | 28 | 10-10-10 | F | F | |
| *482 | 70 | 25 | 5 | 10-10-10 | F | E | |
| *485 | 80 | 10 | 10 | 10-10-10 | E | E | |
| *486 | 72 | 8 | 20 | 10-8-8 | E | F | |
| *487 | 70 | 5 | 25 | 9-8-9 | G | E | |
| *488 | 62 | 30 | 8 | 10-9-10 | E | E | |
| *489 | 50 | 25 | 25 | 10-10-10 | E | E | |
| 490 | 50 | 35 | 15 | 10-10-8 | E | E | |
| 448 | — | — | 100 | 8-1-5 | G | U | Bar cracked |
| *470 | 35 | 29 | 36 | 8-8-7 | E | E | |

*Bars having a composition delineated in FIG. I
E = Excellent
G = Good
F = Fair
U = Unsatisfactory

EXAMPLE 1

63 lbs. of an equal mixture of $C_{12}/C_{14}$ alkane sulfonates (85% active, the balance consisting of $Na_2SO_4$ and related inorganic salts), 21 lbs. of partially hardened coconut oil fatty acid and 16 lbs. of Igepon A (a commercial coconut oil fatty acid ester of sodium isethionate) are homogeneously blended together and then admixed in a chip mixer with 0.3 lb. titanium dioxide, 1.0 lb. of perfume and 7.5 lbs. of water. This charge is then milled 3 times on a high speed 3-roll mill, plodded into logs in a two-stage vacuum plodder, cut and stamped into bars. (This example corresponds to the composition of point X of FIG. 1.

EXAMPLE 2

Example 1 is repeated except that the composition is changed to 75 lbs. of an equal mixture of $C_{12}$ alkane sulfonates, 18 lbs. partially hardened coconut oil fatty acids, and 7 lbs. of a hydroxyalkylmethyl tauride formed by reacting $C_{14}$–$C_{16}$ epoxide with sodium N-methyl taurine.

EXAMPLE 3

Example 1 is repeated except that the composition is changed to 50 lbs. an equal mixture of $C_{10}/C_{14}$ alkane sulfonates (95% active), 25 lbs. (Ethyl Corporation's L-65) synthetic fatty acids consisting of 65% $C_{12}$, 28% $C_{14}$ and 7% $C_{16}$ essentially normal alkanoic acids, and 25 lbs. Igepon T, coco N-methyl tauride.

EXAMPLE 4

80 lbs. of a 50/50 mixture of $C_{10}/C_{14}$ alkane sulfonates (sodium salts), (80% active, the balance consisting of $Na_2SO_4$ and related inorganic salts) are blended in a chip mixer with 25 lbs. of partially hardened coconut oil fatty acids (sodium salts) and 25 lbs. of Igepon A (a commercial coconut oil fatty acid ester of sodium isethionate). To this charge is admixed 1.3 lbs. of perfume and 0.4 lbs. titanium dioxide dispersed in 9 lbs. of water. The total mixture is then milled 3 times on a high speed Day 3-roller mill. The material is then refined, plodded into logs, cut and stamped into bars.

EXAMPLE 5

The sodium salt of an equal mixture of $C_{10}/C_{14}$ alkane sulfonates (95% active), 40 lbs., is dissolved in a mixture of 80 lbs. of anhydrous isopropanol and 125 lbs. of deionized water at 150° F. In this mixture is dissolved 10 lbs. of partially hydrogenated coconut oil fatty acids and 15 lbs. of sodium mono-$C_{14}$-alkyl maleate, and the pH of this solution is adjusted to 6.0 by the addition of a small amount of a 50% aqueous solution of NaOH. The isopropanol is distilled off and the remaining aqueous solution is drum dried. The resulting solid actives are then blended in a chip mixer with 10 lbs. water, 0.2 lb. titanium hydroxide and 0.75 lb. perfume. The chips are plodded into logs, cut to size and finally stamped into bars, having a pH of approximately 6.9.

EXAMPLE 6

In place of the alkane sulfonate of Example 5, there is substituted 40 lbs. of alkane sulfonate made from "cracked wax" $\alpha$-olefins comprised essentially of equal parts of $C_{11}$, $C_{12}$, $C_{13}$ and $C_{14}$ components.

EXAMPLE 7

In place of the 15 lbs. coconut oil fatty acids and 10 lbs. of Igepon A of Example 5 are substituted 10 lbs. of partially hydrogenated coconut oil fatty acids, 10 lbs. of Stephan's $C_{14}C_{18}$ alkane sulfonate and 5 lbs. of 80/20 (tallow/coco) soap chips.

EXAMPLE 8

In place of the 80 lbs. of a 50/50 mixture of $C_{10}/C_{14}$ alkane sulfonates of Example 4, there is substituted a 40/60 mixture.

EXAMPLE 9

In place of the 40/60 mixture of $C_{10}/C_{14}$ alkane sulfonates of Example 8, there is substituted a 60/40 mixture.

What is claimed is:

1. A non-mushing high lathering synthetic toilet bar having a pH of about 4.5–9.5 and comprising based on the total weight of the actives:

i. 40 to about 85% of a primary alkane sulfonate or a mixture of alkane sulfonates wherein the carbon chain contains 12 carbon atoms or averages 12 carbon atoms;

ii. 5 to about 35% of a natural or synthetic fatty acid or mixtures thereof wherein the carbon chain contains or averages 12 carbon atoms;

iii. 5 to about 30% of a binder modifier selected from the group consisting of alkali metal, magnesium and ammonium salts of $C_{12}$–$C_{18}$ primary alkyl sulfates; and iv. based on the total weight of the bar, 5–25% water.

2. The toilet bar of claim 1 wherein the alkane sulfonate is a $C_{12}$ alkane sulfonate.

3. The toilet bar of claim 1 wherein the fatty acids are $C_{12}$ fatty acids.

4. The toilet bar of claim 1 wherein the alkane sulfonate fraction consists of 40–60% of $C_{10}$ homologs and 60–40% of $C_{14}$ homologs.

5. The toilet bar of claim 1 wherein the alkane sulfonate is present in an amount of about 56% and consists of an equal mixture of $C_{10}$ and $C_{14}$ homologs; the fatty acid is present in an amount of about 23%; and the binder modifier is present in an amount of about 16%.

6. The toilet bar of claim 1 wherein the alkane sulfonate is present in an amount ranging from about 55 to about 80%.

7. The toilet bar of claim 6 wherein the fatty acid is present in an amount ranging from about 10 to about 25%.

8. The toilet bar of claim 7 wherein the binder modifier is present in an amount ranging from about 10 to about 25%.

* * * * *

UNITED STATES PATENT AND TRADEMARK OFFICE

CERTIFICATE OF CORRECTION

PATENT NO. : 4,058,487

DATED : November 15, 1977

INVENTOR(S) : Leon M. Prince

It is certified that error appears in the above-identified patent and that said Letters Patent are hereby corrected as shown below:

In the Drawings:

Figure 1: Add an -- x -- at a point corresponding to 63% A, 16% B, and 21% C.

In the Specification:

Col. 3, line 24: "S" should be -- 8 --.

Col. 4, line 16: "$c_{18}$" should be -- $C_{18}$ --.

Col. 4, line 52: "of" should be -- or --.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*